US007344403B2

(12) United States Patent
Major et al.

(10) Patent No.: US 7,344,403 B2
(45) Date of Patent: Mar. 18, 2008

(54) SQUIB CONNECTOR WITH IMPROVED COVER CONNECTION

(75) Inventors: Matthew G. Major, Shelby Township, MI (US); Willie R. Lyons, West Bloomfield, MI (US); Michael S. Glick, Farmington Hills, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/622,022

(22) Filed: Jan. 11, 2007

(65) Prior Publication Data

US 2007/0178730 A1 Aug. 2, 2007

Related U.S. Application Data

(60) Provisional application No. 60/764,048, filed on Jan. 31, 2006.

(51) Int. Cl.
*H01R 13/627* (2006.01)

(52) U.S. Cl. ..... 439/352

(58) Field of Classification Search ..... 439/352
See application file for complete search history.

(56) References Cited

U.S. PATENT DOCUMENTS 6,250,952 B1 * 6/2001 Shiga et al. ..... 439/466
6,799,999 B2 10/2004 Williamson et al. ..... 439/676

OTHER PUBLICATIONS

Safety Restraints Interconnection System—Ferrite Initiator Connectors (FCI) "Right Angle Version—UC Compatible" pp. 2.19-2.20.

* cited by examiner

*Primary Examiner*—Ross Gushi
(74) *Attorney, Agent, or Firm*—Harrington & Smith, PC

(57) ABSTRACT

Disclosed herein is an electrical connector. The electrical connector includes a base, a cover, and an electrical terminal. The base includes a front section and a rear section. The base includes at least one terminal receiving area. The front section includes a first portion of the terminal receiving area. The first portion of the terminal receiving area extends in a first direction. The rear section includes a first snap-lock ledge and a second portion of the terminal receiving area. The second portion of the terminal receiving area extends in a second direction. The first snap-lock ledge extends along a majority of a length of the rear section. The cover includes a top section and a first lateral side section extending from the top section. The first lateral side section receives the first snap-lock ledge. The electrical terminal is mounted between the base and the cover.

20 Claims, 14 Drawing Sheets

SQUIB CONNECTOR WITH IMPROVED COVER CONNECTION

CROSS REFERENCE TO RELATED APPLICATION

This application claims priority under 35 U.S.C. §119(e) to U.S. provisional patent application No. 60/764,048 filed Jan. 31, 2006 which is hereby incorporated by reference in its entirety.

BACKGROUND OF THE INVENTION

1. Field of the Invention

The invention relates to an electrical connector and, more particularly, to a connection of a cover to a housing of an electrical connector.

2. Brief Description of Prior Developments

U.S. Pat. No. 6,799,999, which is hereby incorporated by reference in its entirety, discloses a filtered electrical connector having a cover which is snap-lock connected to a housing. The electrical connector is a Squib connector used in an automobile air bag system.

Referring also to FIGS. 1 and 2, perspective views of a conventional Squib connector 1 and the housing base 2 of the Squib connector 1 is shown. The connector 1 includes a housing cover 3 which is snap-lock connected to the housing base 2. The cover 3 has a rear section with two holes 4 at opposite sides of the rear section. The cover also has a front section with a hole 5. The housing base 2 has three snap-lock projections 6, 7 which snap into the holes 4, 5 when the cover 3 is attached to the base 2. The housing and cover provide a strain relieve feature to the electrical wires 8 by clamping on the wires. There is a desire to increase the ability of the housing base 2 and cover 3 to withstand a 90° pull force as indicated by arrow 9 applied on the terminal wires 8, but while preserving the basic design shown in FIGS. 1 and 2 such that substantial redesign of manufacturing tooling and testing of the new design is not needed.

SUMMARY OF THE INVENTION

In accordance with one aspect of the present invention, an electrical connector is disclosed. The electrical connector includes a base, a cover, and an electrical terminal. The base includes a front section and a rear section. The base includes at least one terminal receiving area. The front section includes a first portion of the terminal receiving area. The first portion of the terminal receiving area extends in a first direction. The rear section includes a first snap-lock ledge and a second portion of the terminal receiving area. The second portion of the terminal receiving area extends in a second direction. The first snap-lock ledge extends along a majority of a length of the rear section. The cover includes a top section and a first lateral side section extending from the top section. The first lateral side section receives the first snap-lock ledge. The electrical terminal is mounted between the base and the cover.

In accordance with another aspect of the present invention, an electrical connector housing is disclosed. The electrical connector housing includes a housing base and a housing cover. The housing base comprises a front section and a rear section. The front section is adapted to receive a first portion of a terminal. The rear section extends from the front section in a general cantilever fashion. The rear section is adapted to receive a second portion of the terminal. The housing cover has a rear section with a general U-shaped cross-section. The housing cover is attached to the housing base. The housing cover includes opposing lateral side sections. Each of the opposing lateral side sections includes a snap-lock groove. The snap-lock grooves are configured to provide a clamping force along a majority of a length of the rear section.

In accordance with yet another aspect of the present invention, an electrical connector is disclosed. The electrical connector includes a base, a cover, and an electrical terminal. The base includes a front section and a rear section. The base includes at least one terminal receiving area. The front section includes a first portion of the terminal receiving area. The first portion extends in a first direction. The rear section includes a second portion of the terminal receiving area. The second portion extends in a second direction. The cover is connected to the base. The cover includes a top section, opposing lateral side sections, and bend sections. The bend sections connect the lateral side sections to the top section. The lateral side sections include a snap-lock hole. The bend sections extend from the snap-lock hole to a rear side of the base. The electrical terminal is mounted between the base and the cover.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 3:
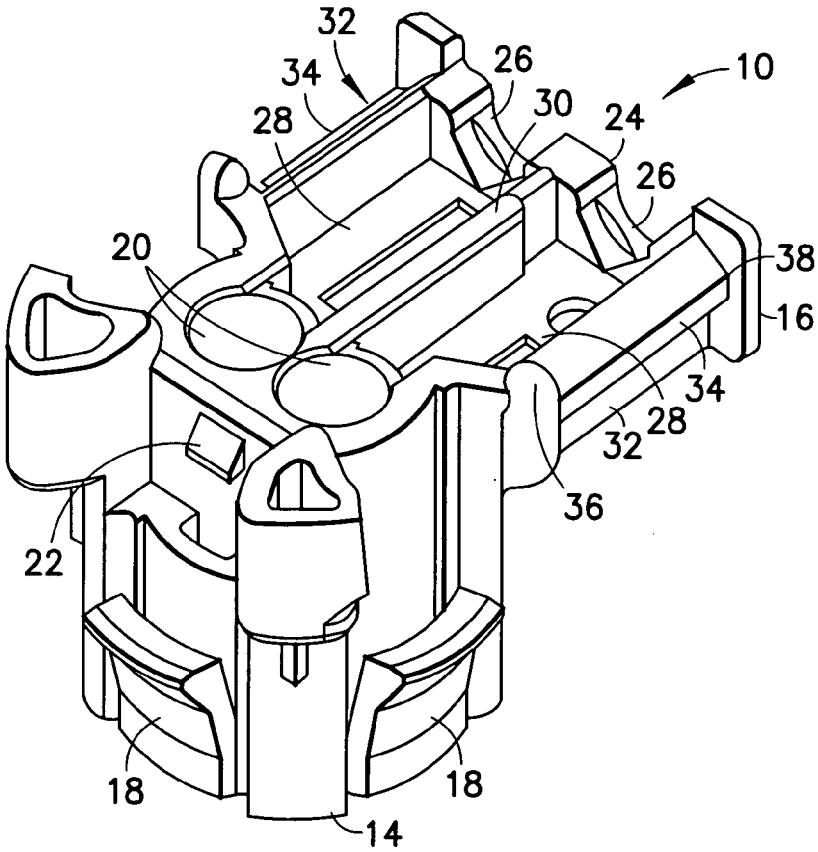
FIG. 3 is a perspective top view of a housing base of an electrical connector incorporation features of the invention.
Figure 4:
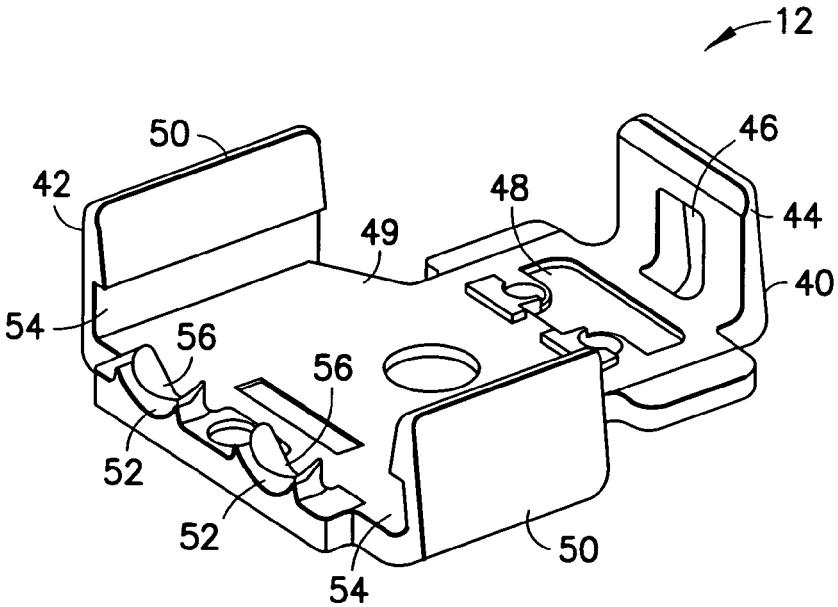
FIG. 4 is a perspective bottom view of a housing cover for use with the housing base shown in FIG. 3.

Referring to FIGS. 3 and 4, there are shown perspective views of an electrical connector housing base 10 and housing cover 12 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

Figure 5:
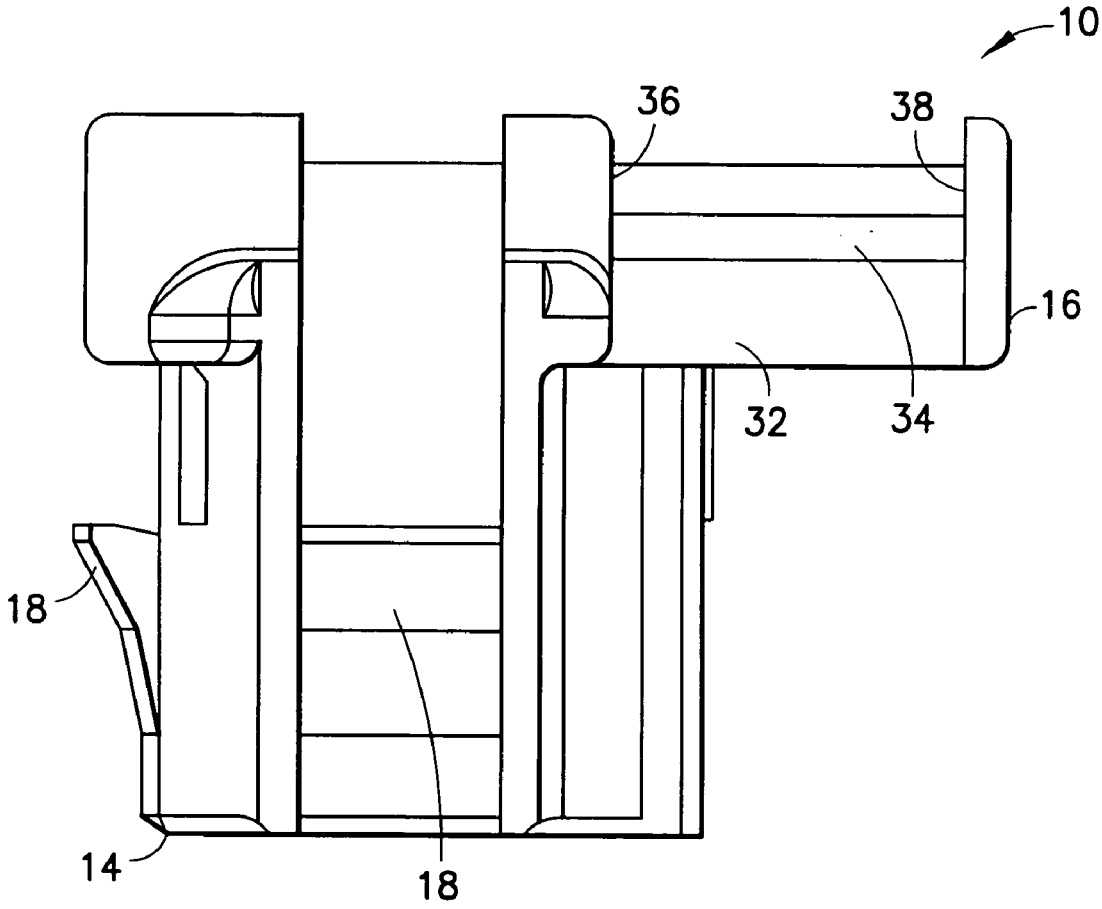
FIG. 5 is an elevational side view of the housing base shown in FIG. 3.

The base 10 and cover 12 are used in conjunction with electrical contacts or terminals, and perhaps other members, such as ferrite tubes, as described in U.S. Pat. No. 6,799,999 to form a Squib electrical connector, such as for use in an automobile air bag system. The base 10 and cover 12 are preferably each a one piece member made of molded plastic or polymer material. Referring also to FIG. 5, the base 10 comprises a front section 14 and a rear section 16. The front section 14 is adapted to be plugged into a socket of another member, such as an air bag initiator socket or another mating electrical connector. The front section 14 comprises snap-lock latches 18 for snap-lock connecting to the mating socket, two channel holes 20 for receiving female sections of the electrical contacts, and a cover snap-lock wedge 22 at the front of the front section proximate the top of the front section. Each of the channel holes 20 (which may also be referred to as first portions of a terminal receiving area) extends in a first direction parallel to a front section 14 mating direction.

The rear section 16 has a rear side 24 with two grooved areas 26 therethrough. The rear section 16 extends from the front section 14 in a general cantilever fashion. The rear section has two channel areas 28 extending from the two grooved areas 26 to the two channel holes 20 in the front section 14. An interior wall 30 is provided separating the channel areas 28 from each other. Lateral side walls 32 are provided at outer lateral sides of the channel areas 28. The exterior sides of the lateral side walls 32 each comprise a snap-lock ledge 34 which extends substantially the entire length of the length of the channel areas 28, such as more than a majority of the length. The snap-lock ledges 34 each have a generally triangular shape with a sloped or angled top side, starting at about the top of the walls 32, and a substantially horizontal bottom side. Front and rear ends of the snap-lock ledges 34 are bounded by front and rear portions 36, 38 of the rear section 16.

The channel areas (or second portions of the terminal receiving area) 28 are adapted to receive rear connections sections of the electrical contacts therein and portions of the electrical wires. The channel areas 28 extend in a second direction which is substantially perpendicular to the first direction of the channel holes 20. The portions of the electrical wires are attached, such as by crimping, to the rear connections sections of the electrical contacts. The electrical wires extend into the channel areas 28 at the grooved areas 26 between the cover 12 and the base 10.

Figure 6:
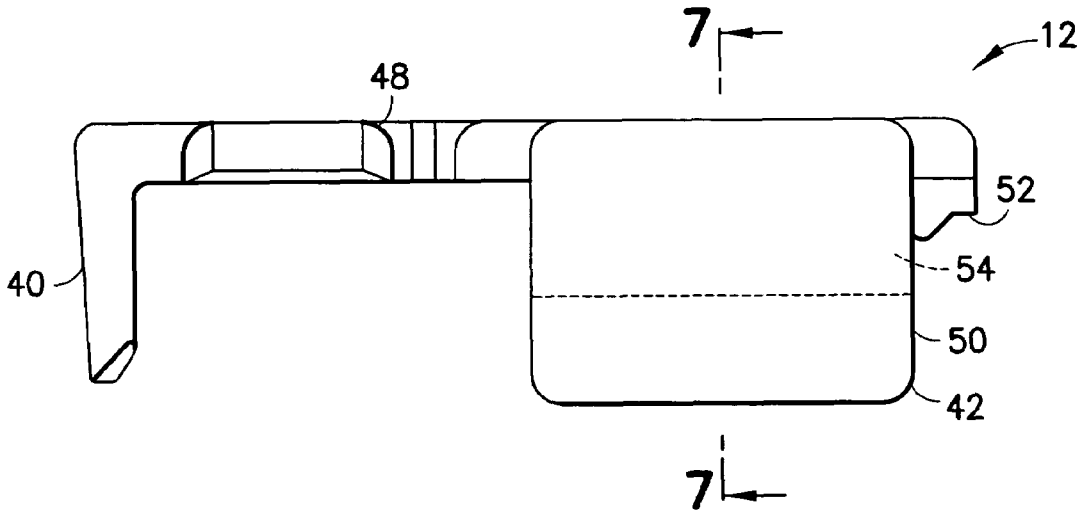
FIG. 6 is an elevational side view of the housing cover shown in FIG. 4.
Figure 7:
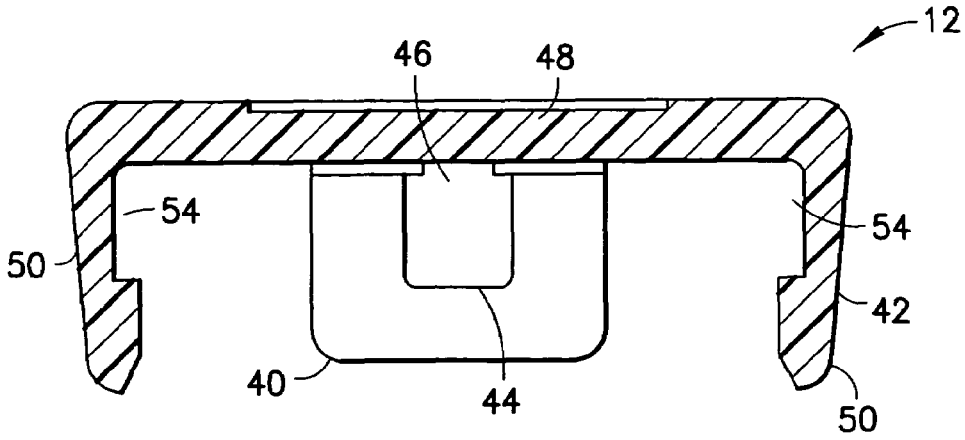
FIG. 7 is a cross sectional view of the housing cover shown in FIG. 6 taken along line 7-7.

Referring also to FIGS. 6 and 7, the housing cover 12 generally comprises a front section 40 and a rear section 42. The front section 40 generally comprises a front snap-lock section 44 with a hole 46 for snap-lock connection to the cover snap-lock wedge 22 at the top front side of the front section 14 of the base 10. The front section 40 has a portion 48 for substantially covering over the channel holes 20. The rear section 42 of the cover 12 has a top section 49, two lateral side snap-lock sections 50 extending downward from opposite lateral sides of the top section 49, and two wire contact sections 52 extending downward from the rear side of the top section 49. The top section 49 and the two lateral side snap-lock sections form a general U-shaped cross-section.

The lateral side snap-lock sections 50 each comprise an interior facing groove 54. When the cover 12 is attached to the base 10, the snap-lock sections 50 are adapted to snap-lock connect to the snap-lock ledges 34 on the housing base 10. The grooves 54 extend the entire length of the rear section with open front and rear ends. Thus, the grooves 54 can receive the entire lengths of the snap-lock ledges 34 therein. This provides an increased area of latching contact (or clamping force) between the cover 12 and the base 10 than previously provided in other conventional Squib connectors.

The two wire contact sections 52 have generally grooved bottom surfaces 56 for contacting the electrical wires. When the cover 12 is snap-lock connected to the base 10, the surfaces 56 and the grooved areas 26 clamp the wires therebetween. This forms a strain relieve for the wires. Because of the increased area of latching contact between the cover 12 and the base 10 at the grooves 54 and snap-lock ledges 34, greater clamping force can be provided on the wires by the base 10 and cover 12.

The snap-lock sections 50 are provided with the elongated grooves or slots 54 rather than through holes as in the prior art. The elongated grooves or slots 54 do not completely extend through the thickness of the snap-lock sections 50. Because the elongated grooves or slots 54 do not completely extend through the thickness of the snap-lock sections 50, the strength of the snap-lock sections 50 are stronger than in the prior art (lateral snap-lock connection sections having through holes therethrough).

Figure 1:
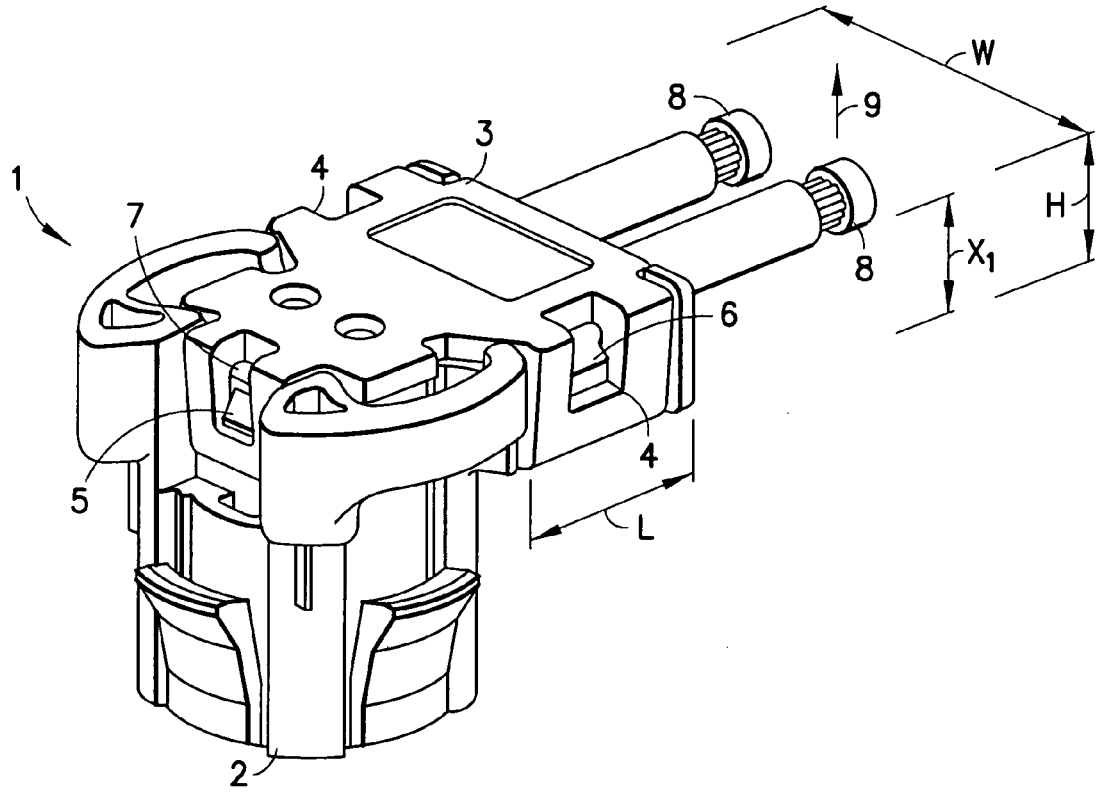
FIG. 1 PRIOR ART
FIG. 1 is a perspective top view of a conventional Squib connector.
Figure 2:
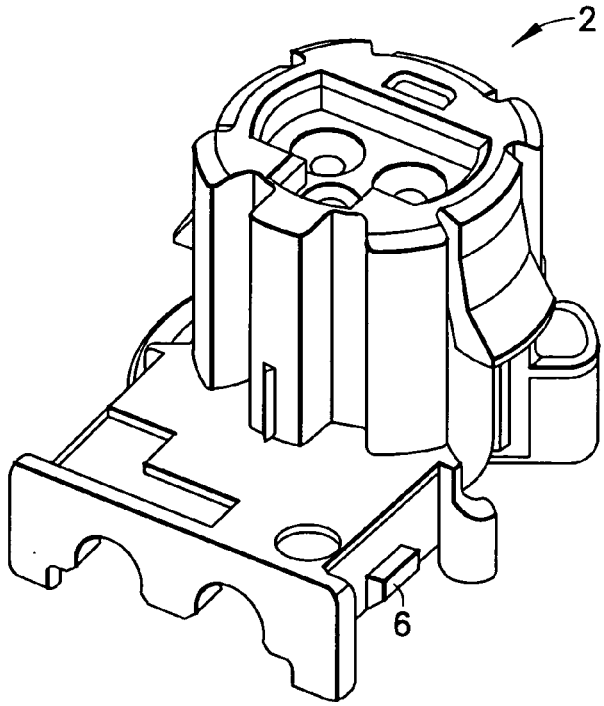
FIG. 2 PRIOR ART
FIG. 2 is a perspective bottom view of the housing base of the connector shown in FIG. 1.
Figure 8:
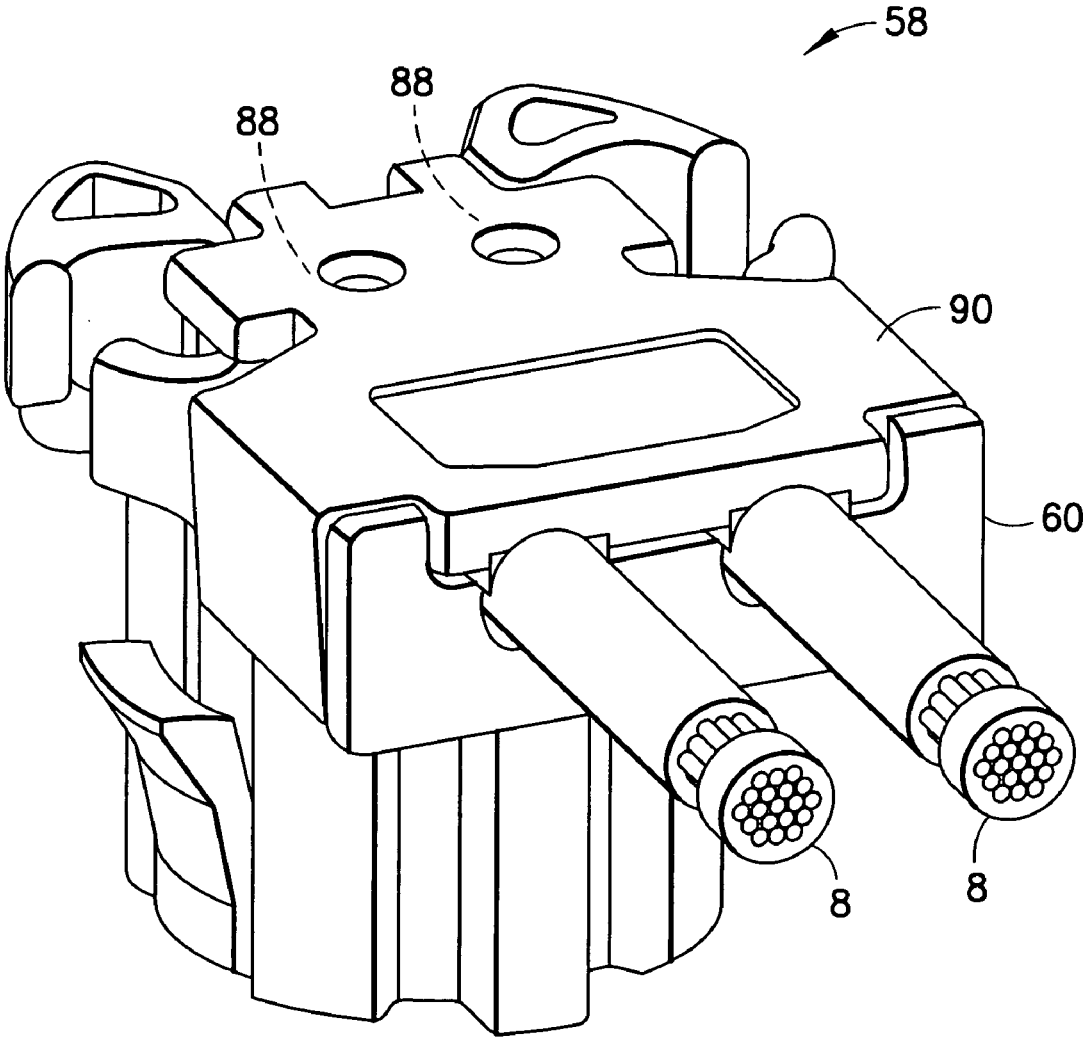
FIG. 8 is a perspective view of an electrical connector comprising the housing base shown in FIG. 3 and the housing cover shown in FIG. 4.

With the invention, the housing and cover can provide an increased resistance to withstand a 90° pull force applied to the terminal wires. The invention allows improving the resistance of the connector to the increased pull force while preserving a basic conventional Squib connector design and overall size, such as a ABX-3 UC Assembly manufactured by FCI USA, Inc as shown in FIGS. 1 and 2. FIG. 8 shows a perspective view of an electrical connector 58 comprising the cover 90, base 60, two wires 8 and two electrical contacts 88.

Referring now to FIGS. 9-12 perspective views of a housing base and FIGS. 13-17 views of a housing cover of an alternate embodiment of a Squib air bag electrical connector is shown. Similar to the first embodiment shown in FIGS. 3-8, the second embodiment is sized and shaped to occupy the same area and shape as the conventional electrical connector shown in FIG. 1. This allows the new connectors to be used instead of the connector 1 without having to be concerned about the surrounding available area and surrounding components which the connector will be located near, such as an automobile steering wheel housing and other components in an automobile steering wheel, or a vehicle occupant seat, or portions of a vehicle frame near the head of an occupant for example. In other words, the new connectors described herein have the same real estate and overall exterior size as the conventional connector 1. This allows a connector incorporating the invention to be used without having to redesign these surrounding components or the surrounding area.

Figure 9:
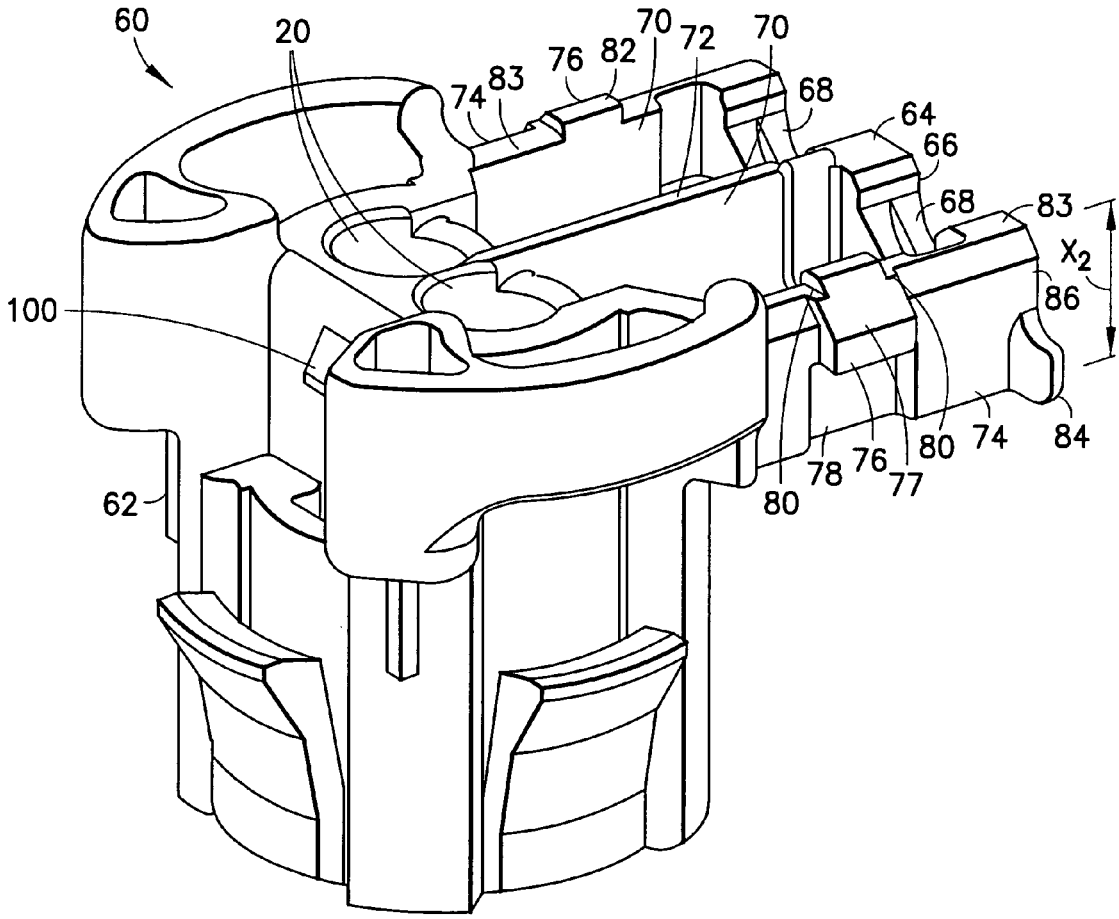
FIG. 9 is a perspective view of an alternate embodiment of a housing base incorporating features of the invention.
Figure 10:
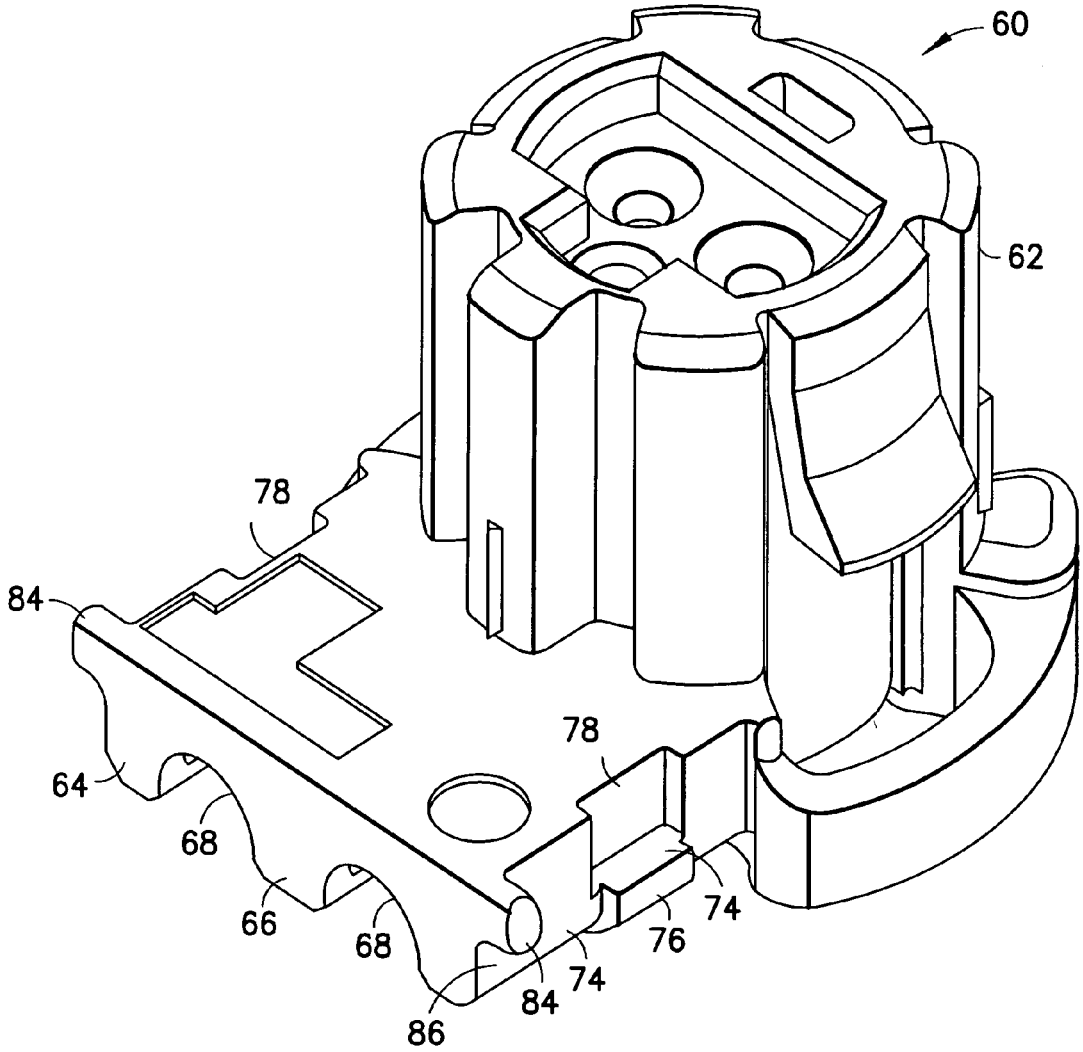
FIG. 10 is a perspective view of the housing base shown in FIG. 9 from an opposite direction.

Referring specifically to FIGS. 9 and 10, the housing base 60 has a front section 62 and a rear section 64. The front section 62 is identical to the front section of the housing base shown in FIG. 1. The rear section 64 generally comprises a rear side 66 with two grooved areas 68 therethrough. The rear section has two channel areas 70 extending from the two grooved areas 68 to the two channel holes 20 in the front section 62. An interior wall 72 is provided separating the channel areas 70 from each other. Lateral side walls 74 are provided at outer lateral sides of the channel areas 70.

Figure 11:
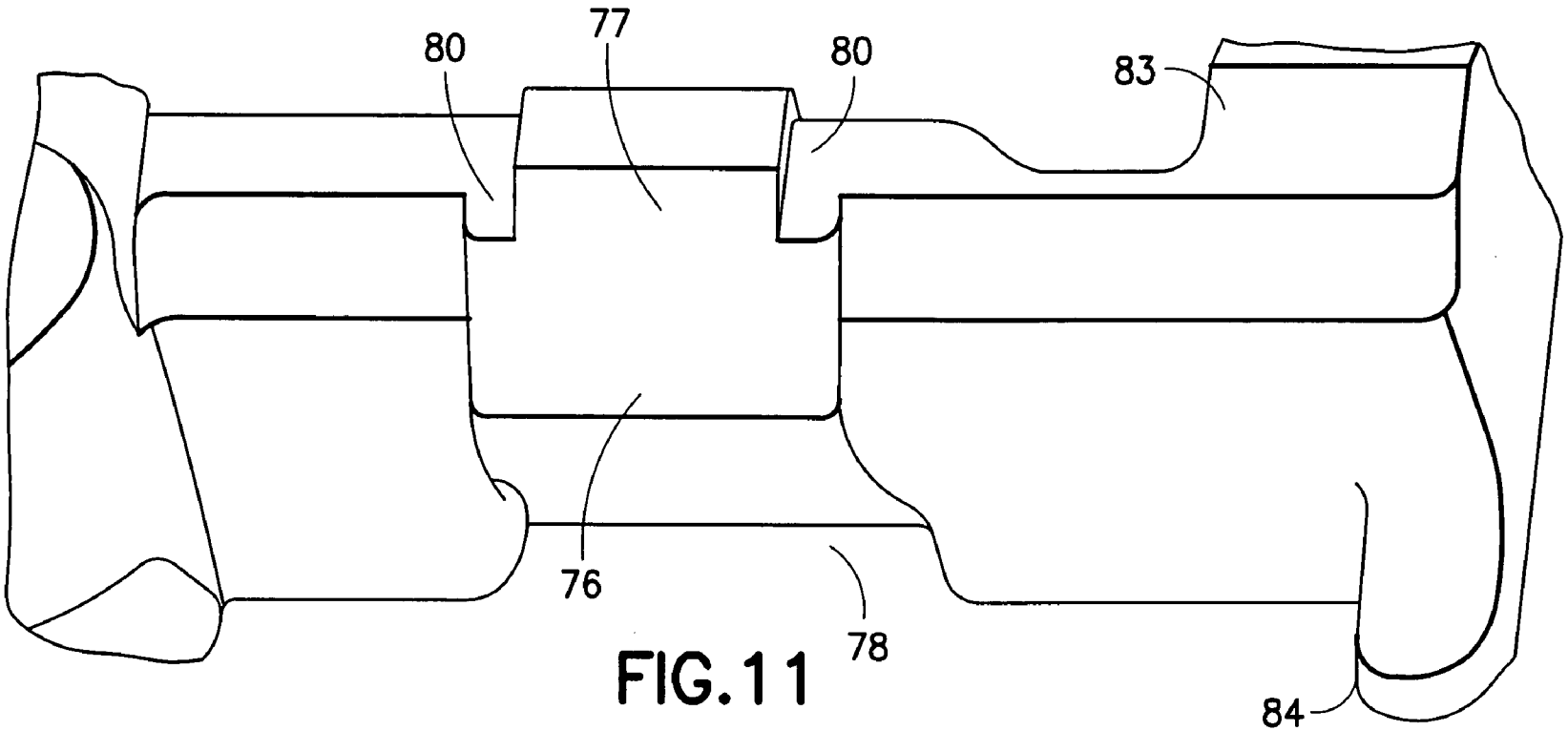
FIG. 11 is a partial enlarged perspective view of a portion of the housing base shown in FIGS. 9-10.
Figure 12:
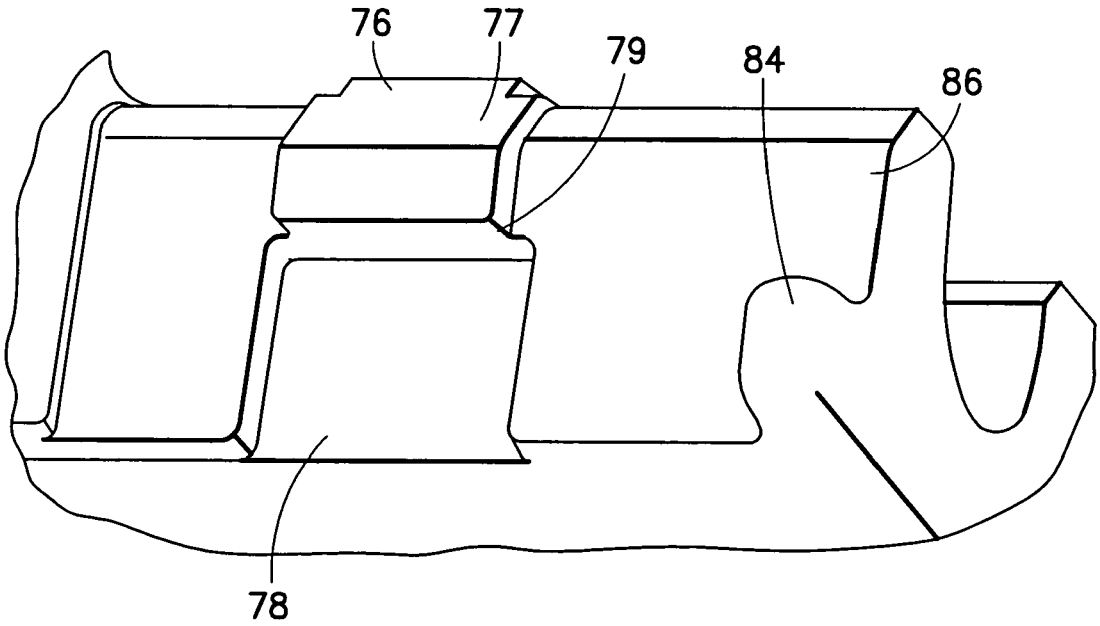
FIG. 12 is a partial enlarged perspective view of a portion of the housing base similar to FIG. 11 taken from another direction.
Figure 13:
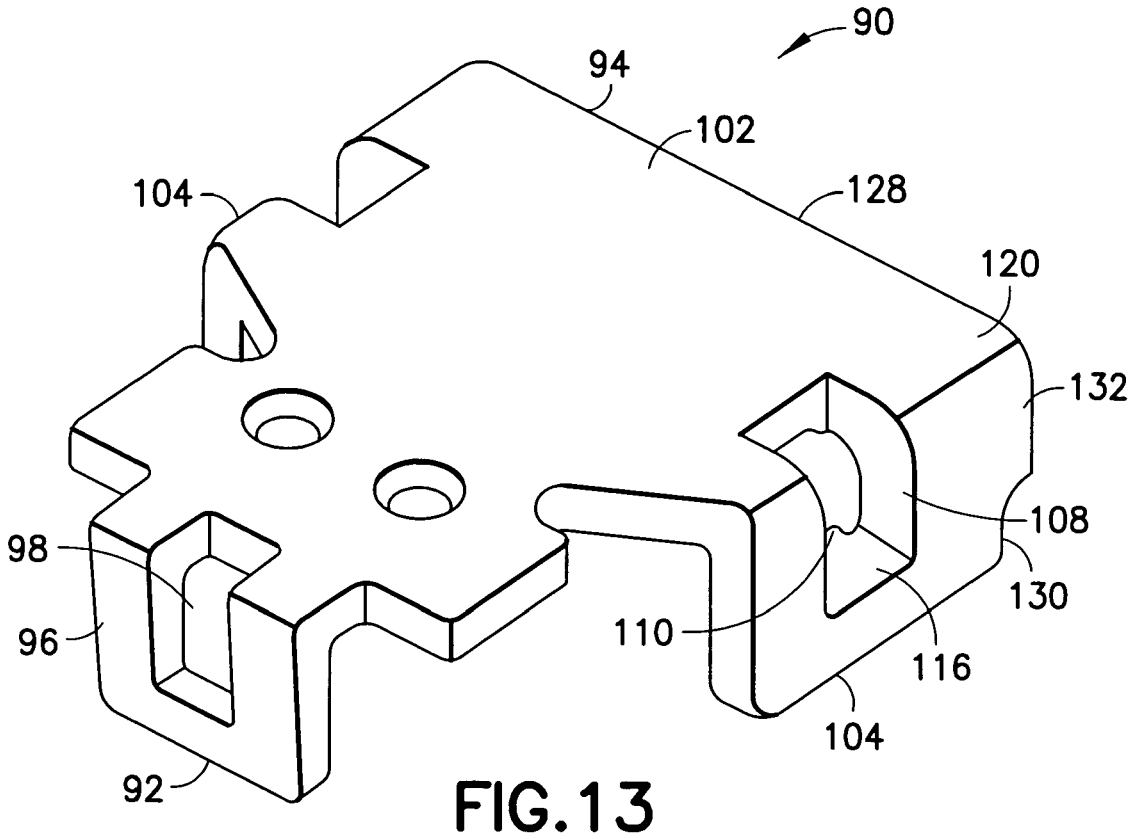
FIG. 13 is a perspective view of an alternate embodiment of a housing cover for use with the base shown in FIGS. 9-12.

Referring also to FIGS. 11 and 12, the exterior sides of the lateral side walls 74 each comprise a snap-lock ledge 76. The snap-lock ledges 76 each have a generally triangular shape with a sloped or angled top side 77 and a substantially horizontal bottom side 79. Unlike the embodiment shown in FIGS. 3 and 5, each snap-lock ledge 76 does not extend substantially the entire length of the rear section. Instead, each snap-lock ledge has a length about the same as the snap-lock ledge 6 used in the conventional connector shown in FIG. 1. The snap-lock ledge 76 has a substantially same size and shape as the snap-lock ledge 6 except for top side recesses 80.

The height $X_2$ of the side walls 74 is lower than the height $X_1$ of the side walls of the base in the connector 1 shown in FIG. 1. Thus, whereas the top of the snap-lock ledge 6 is even with the top of the lateral side walls in the connector 1 of FIG. 1, the top 82 of each snap-lock ledge 76 in the embodiment shown in FIGS. 9-12 extends above the top side 83 of the lateral side walls 74.

The exterior side walls 74 each also comprise a snap-lock pocket 78 located beneath the bottom side of the snap-lock ledges 76. The pockets 78 extend into the side walls 74. The rear end of the lateral side walls 74 each comprise an outward projecting finger (or lateral leg) 84. The finger 84 does not extend the entire height of the lateral side wall. Instead, the fingers 84 projection from a bottom portion of the lateral side walls. This is different from housing base of the conventional connector shown in FIG. 1 which has a rear section that projects outward from the lateral side wall the entire height of the lateral side wall. With the reduced height fingers 84, rear extension areas 86 are provided above the fingers 84 which can accommodate portions 132 of the cover 90 which were not provided in the prior art. The rear extension areas 86 terminate, or are flush, at the rear side 66 of the rear section 64.

The channel areas 70 are adapted to receive rear connections sections of the electrical contacts therein and portions of the electrical wires. The portions of the electrical wires are attached, such as by crimping, to the rear connections sections of the electrical contacts. The electrical wires extend into the channel areas 70 at the grooved areas 68 between the cover 90 and the base 60. The height of the interior wall 72 is substantially the same as the height of the interior wall in the conventional connector shown in FIG. 1. Thus, the height of the interior wall 72 is higher than the height of the lateral side walls 74. However, the height of the rear side 66 is lower than the height of the rear side of the housing base of the conventional connector shown in FIG. 1. Thus, the height of the interior wall 72 is higher than the height of the rear side 66.

Referring now also to FIGS. 13-17, the cover 90 comprises a front section 92 and a rear section 94. The front section 92 is substantially the same as the front section of the housing cover 3 of the conventional connector shown in FIG. 1. The front section 92 comprises a deflectable snap-lock latch section 96 with a hole 98 adapted to snap-lock connect to the snap-lock projection 100 (see FIG. 9) at the front of the housing base 60.

The rear section 94 generally comprises a top section 102, two lateral side snap-lock sections 104 extending downward from opposite lateral sides of the top section 102, and two wire contact sections 106 extending downward from the rear side of the top section 102.

The lateral side snap-lock sections 104 are deflectable in a general cantilever fashion and each comprise a snap-lock latch hole 108. When the cover 90 is attached to the base 60, the snap-lock sections 104 are adapted to snap-lock connect to the snap-lock ledges 76 on the housing base 60. The holes 108 extend entirely through the sections 104, but not the entire length of the sections 104. The holes 108 are sized and shaped to receive the snap-lock ledges 76 therein.

Figure 14:
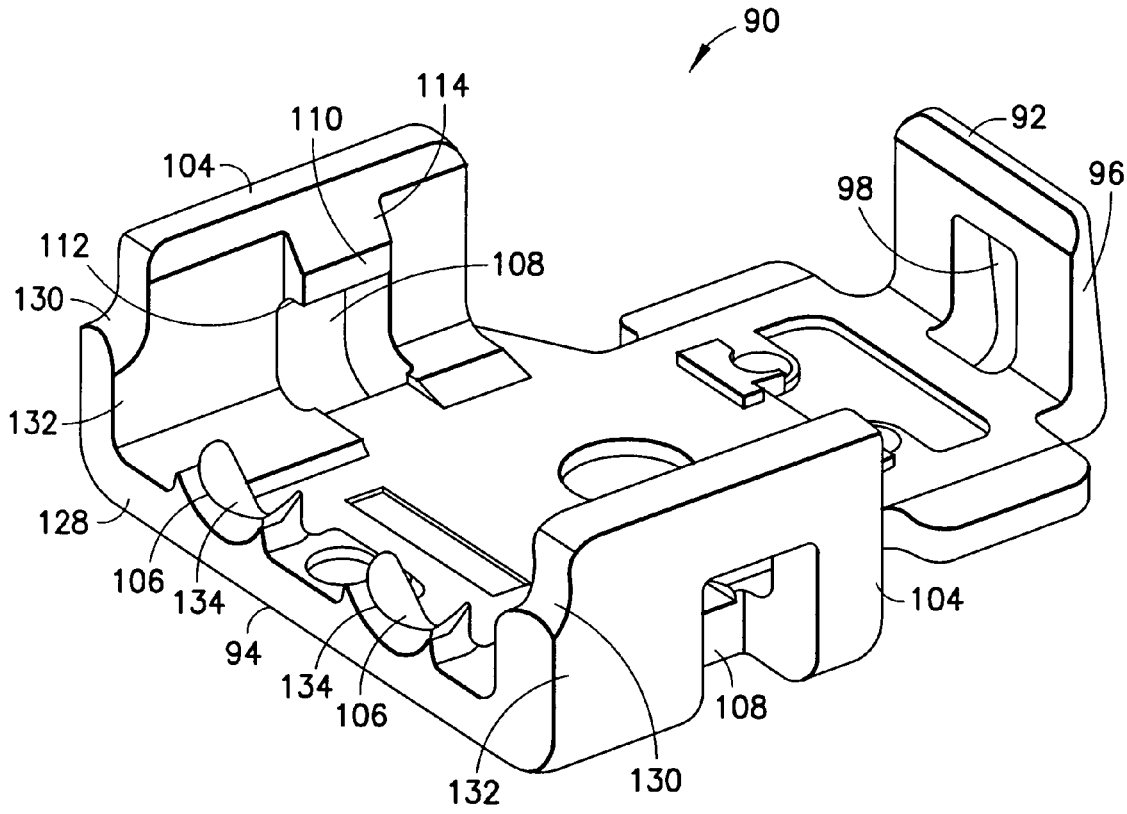
FIG. 14 is a perspective view of the housing cover shown in FIG. 13 from an opposite direction.
Figure 15:
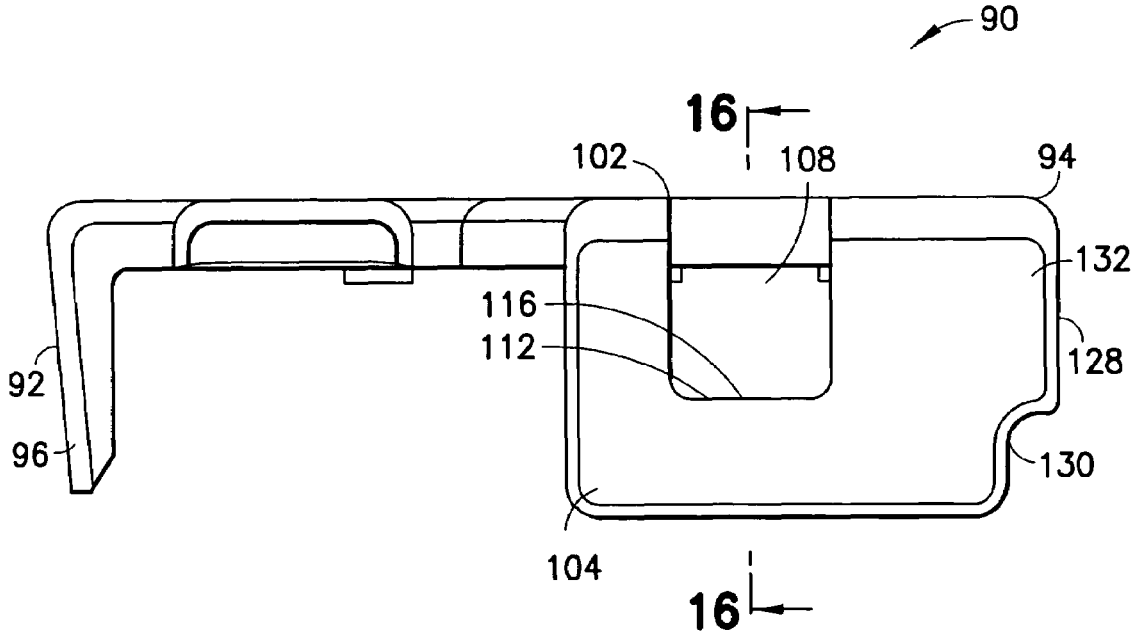
FIG. 15 is a side view of the cover shown in FIG. 13.
Figure 16:
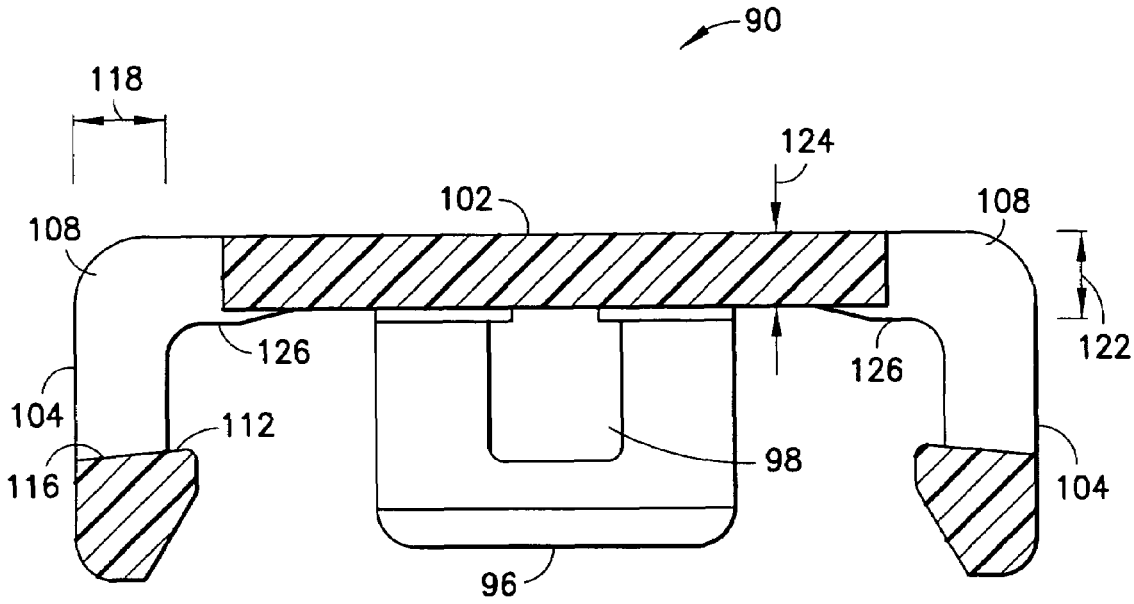
FIG. 16 is a cross sectional view of the cover shown in FIG. 15 taken along line 16-16.
Figure 17:
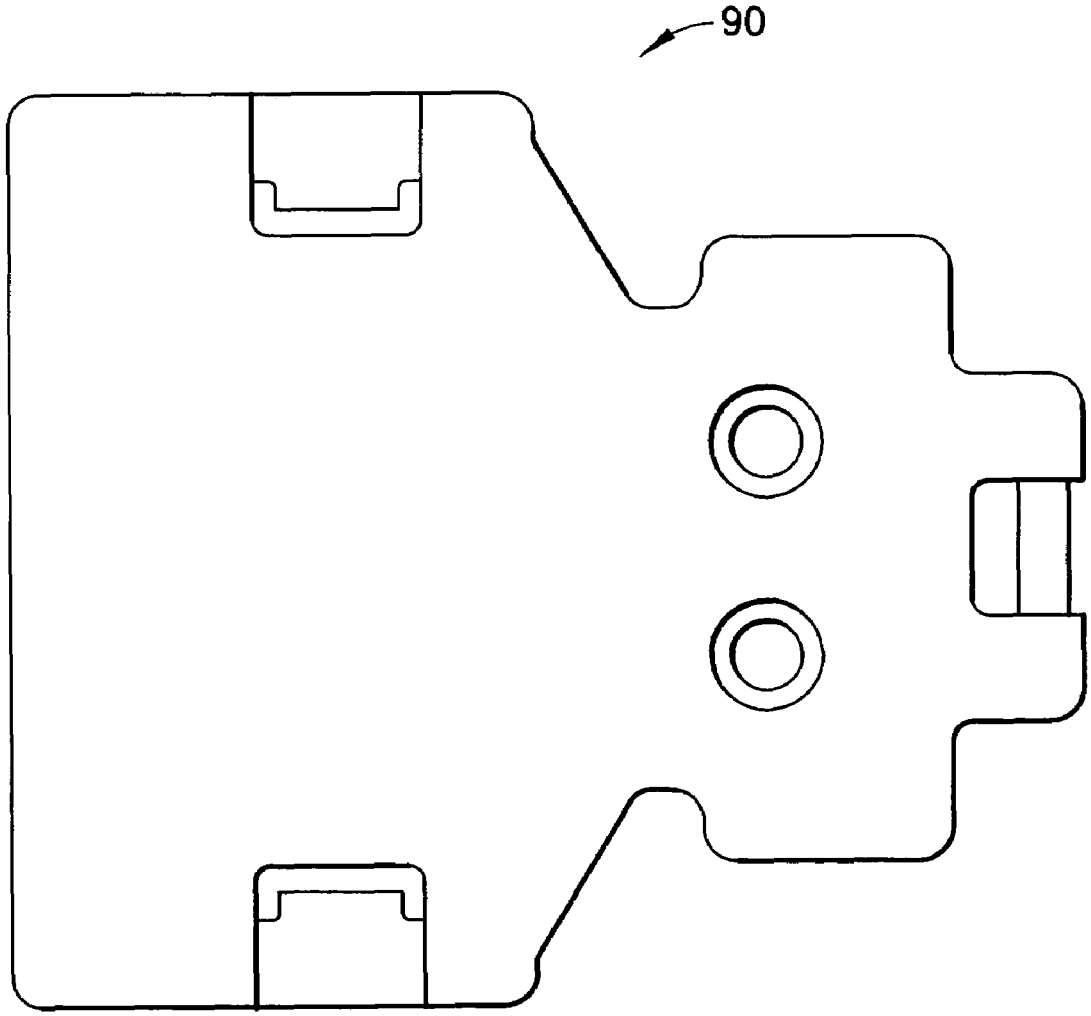
FIG. 17 is a top plan view of the housing cover shown in FIG. 13.

As seen best in FIGS. 14 and 16, each lateral side snap-lock section 104 has an inward projecting snap-lock latch projection 110. Each projection 110 has a top generally flat horizontal side 112 (contiguous with a bottom side 116 of the hole 108) and a sloped bottom side 114. The sloped sides 114 and 77 are adapted to cooperate with each other to resiliently deflect the side sections 104 during attachment of the cover 90 to the base 60. After the cover 90 is attached to the base 60, the side sections 104 resiliently deflect back to their home positions to locate the surfaces 79, 112 directly opposite each other. The snap-lock pocket 78 provides an area for the snap-lock latch projection 110 to extend into.

Referring also to FIG. 16, area 112 combines with area 116 at the bottom of the hole 108 to form an enlarge area of contact between the cover and the base. The width 118 of each sections 104 is larger than the width of the lateral side snap-lock sections in the conventional electrical connector cover 3 shown in FIG. 1. Thus, the size of the area 116 is larger than the equivalent area in the conventional electrical connector cover 3 shown in FIG. 1. The increased size area 116 and area 112 combine to create an even larger area than in the prior art. In the prior art, the size of the area was merely the thickness of the smaller width lateral side snap-lock section at the hole 4. With the combined increased size area 116 and area 112, this increases resistance to pull-off of the cover 90 from the base 60.

The thicknesses of the walls 74 are reduced to accommodate the increased thicknesses 118 of the sections 104. This keeps the outer dimensions of the overall housing the same as the prior art. In an alternate embodiment, the width 118 could be the same as the prior art with merely surfaces 112 adding the additional area.

Portion 126 of the top section 102 proximate the bend (or bend section) 120 of the connection of the lateral side sections 104 to the top section 102 has an increased thickness 122 versus the conventional electrical connector cover 3 shown in FIG. 1. However, the thickness 124 of the top section 102 (except at portion 126 and its rear end) remains the same as the conventional electrical connector cover 3 shown in FIG. 1. The bend 120 has an increased thickness as it transitions from portion 126 to the section 104. The increased thicknesses increase the strength of the bend 120 versus the prior art. This makes it more difficult for the cover 90 to be inadvertently disconnected from the base 60 by pulling action on the electrical wires such as in direction 9 shown in FIG. 1.

The rear section of the cover 90 has a rear end 128. The rear end 128 has bottom notches 130. Each notch 130 is sized and shaped to receive one of the fingers 84 of the base 60 therein. Unlike the conventional electrical connector cover 3 shown in FIG. 1, the lateral side sections 104 extend to the rear end of the connector; except at the notches 130. Thus, the lateral side sections 104 have rear extension portions 132 located above the notches 130 which were not provided in the conventional cover 3. These additional rear extension portions 132 increase the strength of the deflectable bend between the top section 102 and the lateral side sections 104. This makes it more difficult for the cover 90 to be inadvertently disconnected from the base 60 by pulling action on the electrical wires.

The two wire contact sections 106 have generally grooved bottom surfaces 134 for contacting the electrical wires. When the cover 90 is snap-lock connected to the base 60, the surfaces 134 and the grooved areas 68 clamp the wires therebetween. This forms a strain relieve for the wires. Because of the increased area of latching contact between the cover 90 and the base 60, greater clamping force can be provided on the wires by the base 60 and cover 90.

With the embodiment shown in FIGS. 9-17, even though the sizes 118 and 122 of the cover 90 have been increased, reductions in the corresponding areas of the base 60 have been made to maintain the overall exterior dimensions of the housing to be the same as the housing of the conventional connector shown in FIG. 1. The increased sizes 118, 122 increase the pull-off resistance of the cover 90 from the base 60 by a pull force on the wires. In addition, the addition of the portions 132 and snap-lock projections 110 (with pockets 78 in the base 60) provide an even greater pull-off resistance of the cover 90 from the base 60 by a pull force on the wires, such as direction 9 shown in FIG. 1. In alternate embodiments, more or less than all of these pull-off resistance features could be provided. With the embodiments described above, the overall length L, width W and height H of the rear section of the prior art connector 1 shown in FIG. 1 is the same as the length, width and height of the connectors shown in FIGS. 3-17. However, the connector housings shown in FIGS. 3-17 have an increased resistance to pull-off of the housing cover from the housing base versus the prior art connector shown in FIG. 1.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a base comprising a front section and a rear section, wherein the base comprises at least one terminal receiving area, wherein the front section comprises a first portion of the terminal receiving area extending in a first direction, wherein the rear section comprises a first snap-lock ledge and a second portion of the terminal receiving area extending in a second direction, and wherein the first snap-lock ledge extends substantially an entire length of the rear section;

a cover comprising a top section and a first lateral side section extending from the top section, wherein the first lateral side section receives the first snap-lock ledge; and an electrical terminal mounted between the base and the cover.

2. The electrical connector of claim 1 wherein the rear section further comprises a front portion and a rear portion, and wherein the first snap-lock ledge extends from the front portion to the rear portion.

3. The electrical connector of claim 1 wherein the rear section further comprises a second snap-lock ledge opposite the first snap-lock ledge, and wherein the second snap-lock ledge extends along the majority of the length of the rear section.

4. The electrical connector of claim 3 wherein the cover further comprises a second lateral side section extending from the top section, wherein the second lateral side section receives the second snap-lock ledge.

5. The electrical connector of claim 1 wherein the first lateral side section of the cover further comprises a groove, wherein the first snap-lock ledge is disposed within the groove.

6. The electrical connector of claim 5 wherein the groove comprises open opposite ends along a length of the first lateral side section.

7. An electrical connector housing comprising:

a housing base comprising a front section and a rear section, wherein the front section is adapted to receive a first portion of a terminal, wherein the rear section extends from the front section in a general cantilever fashion, and wherein the rear section is adapted to receive a second portion of the terminal; and a housing cover having a rear section with a general U-shaped cross-section attached to the housing base, wherein the housing cover comprises opposing lateral side sections, wherein each of the opposing lateral side sections comprises a snap-lock groove, and wherein the snap-lock grooves are configured to provide a clamping force along substantially an entire length of the rear section.

8. The electrical connector housing of claim 7 wherein the snap-lock grooves comprise open opposite ends along a length of each of the lateral side sections.

9. The electrical connector housing of claim 7 wherein the housing cover further comprises grooved surfaces extending from a top section of the housing cover, wherein the grooved surfaces are configured to provide a clamping force to the terminal in response to the clamping force along the majority of the length of the rear section.

10. The electrical connector housing of claim 7 wherein the rear section of the housing base comprises opposing snap-lock ledges disposed within the snap-lock grooves.

11. The electrical connector housing of claim 10 wherein the rear section of the housing base further comprises channel areas extending between the front section and a rear side of the rear section, and wherein the snap-lock ledges extend along a majority of a length of the channel areas.

12. The electrical connector housing of claim 10 wherein the rear section of the housing base further comprises a front portion and a rear portion, and wherein each of the snap-lock ledges extend from the front portion to the rear portion.

13. An electrical connector comprising:

a base comprising a front section and a rear section, wherein the base comprises at least one terminal receiving area, wherein the front section comprises a first portion of the terminal receiving area extending in a first direction, and wherein the rear section comprises a second portion of the terminal receiving area extending in a second direction;

a cover connected to the base, wherein the cover comprises a top section, opposing lateral side sections, and bend sections connecting the lateral side sections to the top section, wherein the lateral side sections comprise a snap-lock hole, and wherein the bend sections extend from the snap-lock hole to a rear side of the base; and an electrical terminal mounted between the base and the cover.

14. The electrical connector of claim 13 wherein the rear section of the base further comprises side walls disposed laterally outward from the second portion of the terminal receiving area, and wherein lateral legs extend from bottom portions of the side walls adjacent the rear side.

15. The electrical connector of claim 14 wherein the side walls further comprise a rear extension area above the lateral legs.

16. The electrical connector of claim 15 wherein each of the lateral side sections of the cover further comprise a rear extension portion, wherein the rear extension area is configured to accommodate the rear extension portion.

17. The electrical connector of claim 16 wherein each of the rear extension portions extend from the lateral side sections and terminate at the rear side of the base.

18. The electrical connector of claim 14 wherein each of the side walls further comprise a top side and a snap-lock ledge, wherein a top of the snap-lock ledge extends above the top side of the side wall.

19. An electrical connector comprising:

a base comprising a front section and a rear section, wherein the base comprises at least one terminal receiving area, wherein the front section comprises a first portion of the terminal receiving area extending in a first direction, wherein the rear section comprises a second portion of the terminal receiving area extending in a second direction, wherein the rear section comprises side walls disposed laterally outward from the second portion of the terminal receiving area, and wherein lateral legs extend from bottom portions of the side walls adjacent the rear side;

a cover connected to the base, wherein the cover comprises a top section, opposing lateral side sections, and bend sections connecting the lateral side sections to the top section, wherein the lateral side sections comprise a snap-lock hole, wherein the bend sections extend from the snap-lock hole to a rear side of the base, wherein each of the lateral side sections comprises a notch, and wherein the notch receives one of the lateral legs; and an electrical terminal mounted between the base and the cover.

20. An electrical connector comprising:

a base comprising a front section and a rear section, wherein the base comprises at least one terminal receiving area, wherein the front section comprises a first portion of the terminal receiving area extending in a first direction, and wherein the rear section comprises a second portion of the terminal receiving area extending in a second direction;

a cover connected to the base, wherein the cover comprises a top section, opposing lateral side sections, and bend sections connecting the lateral side sections to the top section, wherein the lateral side sections comprise a snap-lock hole, wherein the bend sections extend from the snap-lock hole to a rear side of the base, and wherein a thickness of the lateral side sections and a thickness of the bend sections of the cover are each greater than a thickness of the top section of the cover; and an electrical terminal mounted between the base and the cover.

* * * * *